US005830257A

United States Patent [19]

Fujimaki et al.

[11] Patent Number: 5,830,257

[45] Date of Patent: Nov. 3, 1998

[54] MANUFACTURING METHOD FOR ALUMINA-DISPERSED REINFORCED COPPER

[75] Inventors: Hirohiko Fujimaki, Shizuoka; Manabu Kiuchi, Kanagawa; Tetsuya Takaai, deceased, late of Tokyo, all of Japan

[73] Assignee: Yazaki Corporation, Tokyo, Japan

[21] Appl. No.: 701,461

[22] Filed: Aug. 22, 1996

[30] Foreign Application Priority Data

Aug. 24, 1995 [JP] Japan ..... 7-216082

[51] Int. Cl.[6] ..... C22C 9/00

[52] U.S. Cl. ..... 75/351; 75/228; 75/232; 75/235; 75/234; 75/255; 75/343; 75/363; 75/333; 75/340

[58] Field of Search ..... 75/228, 232, 235, 75/234, 255, 343, 351, 363, 333, 340

[56] References Cited

U.S. PATENT DOCUMENTS

| | | | |
|---|---|---|---|
| 3,779,714 | 12/1973 | Nadkarni et al. | 29/182.5 |
| 3,884,676 | 5/1975 | Nadkarni et al. | 75/0.5 |
| 4,315,770 | 2/1982 | Nadkarni | 75/0.5 |
| 4,315,777 | 2/1982 | Nadkarni et al. | 75/232 |
| 4,440,572 | 4/1984 | Nadkarni et al. | 75/232 |
| 4,752,334 | 6/1988 | Nadkarni et al. | 75/235 |
| 4,999,336 | 3/1991 | Nadkarni et al. | 505/1 |
| 5,004,498 | 4/1991 | Shimamura et al. | 75/233 |

FOREIGN PATENT DOCUMENTS 63-241126 10/1988 Japan .

*Primary Examiner*—Patrick Ryan
*Assistant Examiner*—M. Alexandra Elve
*Attorney, Agent, or Firm*—Armstrong, Westerman, Hattori, McLeland & Naughton

[57] ABSTRACT

A manufacturing method for an alumina-dispersed reinforced copper alloy according to the invention is an improved method which is capable of manufacturing efficiently alumina-dispersed reinforced copper having both good electro-conductivity used for wire-manufacturing-material and good mechanical property, the manufacturing method comprises the steps of obtaining powders constituted by particles having aluminum-contained copper alloy-oxide, allowing to mill aluminum-contained copper alloy powder within the air atmosphere by milling device with mechanical-alloying-operation due to shock compression, converting aluminum into aluminum-oxide by heat-treatment of the powders within inert atmosphere, implementing reduction-treatment of the converted member within the reducing atmosphere, and executing hot extrusion the reduction-treated-material.

8 Claims, No Drawings

MANUFACTURING METHOD FOR ALUMINA-DISPERSED REINFORCED COPPER

BACKGROUND OF THE INVENTION

1. Field of the Invention

The present invention relates to a manufacturing method for an alumina-dispersed reinforced copper, and more particularly to a manufacturing method for a copper material suitable for manufacturing electric wires with high mechanical strength and high electro-conductivity.

2. Description of the Prior Art

In order to manufacture electric wires with strong tensile strength and high electro-conductivity, the use of an alumina-dispersed reinforced copper has been traditionally known. In the manufacturing method of such alumina-dispersed reinforced copper according to the Japanese Patent Publication No. 55-39617, it causes powders of copper alloy including aluminum to oxidize on surface thereof with the powder of copper alloy roasted within an oxygen-atmosphere, and then heat-treating the surface-oxidation powder of copper alloy within an inert gas atmosphere so as to oxidize the aluminum internally, and to deoxidize copper-oxide to the copper, whereby the copper as a parent body is reinforced by a finely dispersed alumina.

On the other hand, there is the other method to obtain alumina-dispersed copper material as disclosed in the Japanese Patent Application Laid-Open No. 61-149449, wherein powdered copper and powdered aluminum-oxide have been sufficiently milled in the milling apparatus such as a ball mill and so forth, and come into blended mixture, then the alumina-dispersed copper material have been obtained through the step of the hot extrusion. Although the method in accordance with the mixed-dispersion is simple compared to the method of internal oxidation of copper-aluminum alloy as described above, reinforcing property is insufficient and there is a problem about uniformity of quality.

Furthermore, also there is a method for obtaining alumina-dispersed reinforced copper material wherein copper oxide, copper-aluminum alloy and copper have been sufficiently milled, and then treatment of internal oxidation is applied to them, further only copper oxide is reduced under reducing condition to close-mixture between copper and aluminum oxide. Although this method of oxide-mixing internal oxidation is superior in reinforcing property to the method of mixing-dispersion as described above, furthermore although this method is simple compared to the method of surface-heat-oxidation internal oxidation, and improves uniformity of quality thereof, there is a problem that reinforcing property is not extended to the method of surface-heat-oxidation.

As described above, in conventional technic which has manufactured copper material for manufacturing electric wires remaining high electro-conductivity by alumina-dispersed reinforcing, the copper material which has both mechanical property such as tensile strength and elongation property and electro-conductivity, suitable for using as electric wires, has been incapable of obtaining economically with high productivity.

SUMMARY OF THE INVENTION

In view of the foregoing, it is an object of the present invention to provide a manufacturing method for an alumina-dispersed reinforced copper which is capable of being manufactured alumina-dispersed reinforced copper combining both good electro-conductivity and good mechanical property suitable for using as material for manufacturing-electric wires with high productivity.

According to one aspect of the present invention, for achieving the above-mentioned object, there is provided a manufacturing method for an alumina-dispersed reinforced copper which comprises the steps of obtaining powders constituted by particle including aluminum-contained copper alloy-oxide, allowing to mill aluminum-contained copper alloy powder within the air atmosphere by means of a milling device with mechanical-alloying-operation due to shock compression, converting aluminum into aluminum-oxide by heat-treating of the powders within an inert atmosphere, implementing reduction-treatment of the converted material within the reducing atmosphere, and executing hot extrusion of the reduction-treated-material.

DETAILED DESCRIPTION OF THE PREFERRED EMBODIMENTS

A preferred embodiment of the invention will now be described in detail.

In the manufacturing method of alumina-dispersed reinforced copper according to the invention, composition for aluminum-contained copper alloy as material is not limited specially, however it might be selected that a desired ratio of aluminum to copper become 0.1 to 0.6 weight-% when the alumina-dispersed reinforced copper is used for material for electric wires. When the ratio of aluminum is below this range, improvement for strength of material is insufficient, while when the ratio of aluminum exceeds this range, it becomes difficult to process wire stretching effectively because of decrease in workability.

It is preferable that such powder of aluminum-contained copper alloy might be atomized by water-atomization method, it's also preferable that average particle diameter thereof is 20 $\mu$m. Even if average particle diameter of the powder exceed 20 $\mu$m, there is no serious hindrance particularly when the particle diameter is linear up to constant value, while it is desirable that in the powder, large-sized unwanted particles are not contained therein since the characteristics of reinforced copper products are tend to vary when the distribution of particle diameter is wide.

Method of mechanical alloying according to the present invention is of method in which pressure welding or grinding of metallic finely divided particles are repeated by employing an energy-rich ball mill and so forth, it causes the alloying to progress while inducing diffusion phenomenon between metallic finely divided particles under pressure welding, combined therewith operation for solidifying thereof is performed. It is simply referred hereinafter as MA. It is necessary that mills employed for processing powder of aluminum-contained copper alloy as stated above should have operation of mechanical alloying by virtue of shock compression, for example a ball mill or a tubing mill are capable of being employed, the ball mill is the most suitable one thereamong. Furthermore, the material of balls used in these mills has characteristics of high degree of hardness and good wearing, for example, wearing-property alloy, such as stainless steel, carbide-alloy, ceramics such as alumina, zirconia and so forth in particular, it is more preferable to use ceramics ball such as alumina or zirconia so as not to injure the electric property of copper.

In the method of the present invention, aluminum-contained copper alloy powder is milled by shock-crush operation of the milling device as described above on account of the forging operation and granulation operation acting thereon, further meanwhile these are oxidized by oxygen within the atmosphere with the result that aluminum-contained copper alloy powder becomes powder consisting of particle with uniform composition containing oxides of copper or aluminum. Under these circumstances, crush-oxidation-treatment condition of powder in particular treatment time is changed by the quality of the material and shape of the milling device concerning structure and capacity. Particularly, in case of the ball mill and so forth, crush-oxidation-treatment condition of powder is changed by the quality of the material or size of container, the quality of the material or size or weight of ball, the number being used about the ball, or rotational speed of the device. The treatment time is of the necessary time for combining contained aluminum with enough amount of oxygen wherein aluminum is converted into oxide in the subsequent internal oxidation process. Accordingly the treatment time is capable of being determined ahead of time.

The treatment time determined in this way is of the minimum time for require and then no problem is brought by continuing the crush-oxidation-treatment. however too long treatment time is undesirable because deterioration of both of production efficiency and physical property is brought therefrom. Further Since it is advantageous to the subsequent progress stage of work in that diameter of the obtained particle is generally less than 150 $\mu$m in such process, it is desirable to select the operating condition of the milling device so as to enter the diameter of the particle into the above limits.

Thus obtained powder is made heat treatment within inert atmosphere as with conventional internal oxidation method, by virtue thereof aluminum is converted into aluminum oxide, at the same time, causing copper oxide to convert into metallic copper, next these converted members are made heat-reducing treatment within atmosphere containing reducing gas such as hydrogen and so forth so as to reduce remaining oxygen. Furthermore, material for electric wire is obtained by hot extrusion utilizing technic of powder metallurgy.

[EMBODIMENT]

Alloyed powder, mean particle size of which is approximately 20 $\mu$m is obtained in such a manner that melt of copper aluminum alloy containing 0.35 weight-% of aluminum is contacted with water jet. 200 g of this powder is putted into zirconia-made centrifugal-rotary ball mill (capacity 500 ml). The powder and zirconia-made 10 mm-diameter ball 1 kg are rotated at 250 rpm within atmosphere so as to mill. Furthermore, crush-oxidation-treatment is performed in such a way that milling time is changed in multistage from one hour to 96 hours, then taking it out, and each powder sample is obtained. Moreover, for comparison, it is prepared the powder sample which is not milled by ball mill, and the powder sample which is made surface heat oxidation by heat treatment of 300° C., 10 minutes within atmosphere instead of milling.

Next, each of these powders are put into alumina-made container and are treated 700° C.-one-hour heat-treatment within nitrogen-atmosphere so that aluminum within alloy is converted into aluminum oxide in company with the majority of oxide of copper is reduced to copper. Furthermore, these are crushed to piece after cooling so as to select particle size in 60 $\mu$m. These are put into alumina-made container and are treated 500° C. -one-hour heat-treatment within hydrogen-atmosphere so that all remaining oxide of copper are reduced to copper.

Thus obtained each alumina containing reduced copper powder is solidified by a plasma discharge sintering device so as to obtain a shaped body as diameter; 17.5 mm, length; 15 mm. Furthermore, these shaped bodies are sealed within oxygen-free-copper-made cylinder in vacuum atmosphere so as to obtain extrusion-billet.

Next, it causes these billets to heat at a temperature of 850° C., performing a hot extrusion under condition of die-temperature; 300° C., extrusion ratio 64 so that 2.5 mm-diameter copper-rough drawing line is obtained. Thus obtained copper-rough drawing line is drawn so as to come into 1 mm-diameter. About the 1 mm-diameter drawing copper line, tensile strength (N/mm$^2$ ), elongation (%), and electro-conductivity (% IACS) have been measured.

The result is shown in Table 1.

TABLE 1

| MANUFACTURING CONDITION | | CHARACTERISTICS FOR WIRE MATERIAL | | | | | |
|---|---|---|---|---|---|---|---|
| | | BEFORE ANNEALING | | | AFTER ANNEALING | | |
| TEST NUMBER | CRUSH-OXIDATION METHOD (hrs) | ELECTRO-CONDUCTIVITY (% IACS) | TENSILE-STRENGTH (M/mm$^2$) | ELONGATION (%) | ELECTRO-CONDUCTIVITY (% IACS) | TENSILE-STRENGTH (M/mm$^2$) | ELONGATION (%) |
| 1* | 0 | 77.6 | 441 | 4.4 | 76.6 | 309 | 14.2 |
| 2 | 1 | 84.6 | 642 | 5.0 | 88.2 | 564 | 8.6 |
| 3 | 2 | 83.8 | 654 | 4.3 | 85.4 | 551 | 9.3 |
| 4 | 3 | 83.3 | 661 | 4.7 | 84.4 | 552 | 8.6 |
| 5 | 4 | 82.5 | 664 | 5.2 | 85.4 | 562 | 9.0 |
| 6 | 5 | 82.5 | 667 | 5.7 | 85.6 | 564 | 9.6 |
| 7 | 6 | 80.7 | 741 | 5.2 | 85.3 | 591 | 8.6 |
| 8 | 12 | 80.0 | 646 | 4.6 | 81.0 | 540 | 8.6 |
| 9 | 24 | 85.5 | 556 | 4.4 | 88.0 | 475 | 8.0 |
| 10 | 48 | 84.2 | 483 | 5.0 | 91.1 | 404 | 9.4 |
| 11 | 96 | 84.0 | 570 | 4.2 | 84.2 | 490 | 8.4 |
| 12* | SURFACE-HEAT-OXIDATION METHOD | 85.2 | 645 | 4.5 | 85.4 | 523 | 9.0 |

*REFERENCE EXAMPLE

From these result, strain hardening caused by the ball mill and surface oxidation proceed concurrently. For these reasons, the copper wire material obtained by this method has the same characteristics as that of the copper wire material manufactured by conventional method in which surface heat oxidation and internal oxidation are executed. Namely these material has good characteristics of electro-conductivity, tensile strength and elongation. It has been known that mechanical crushing-mixing method brings large-amount treatment thereof.

The manufacturing method for an alumina-dispersed reinforced copper according to the present invention allows the aluminum-contained copper alloy powder to perform with milling-treatment by the milling-apparats having MA operation caused by shock compaction. Then, copper material is obtained by internal oxidation treatment. According to the manufacturing method for the alumina-dispersed reinforced copper of the invention, there is obtained a copper material in that dispersion of alumina is uniform, electro-conductivity is very good, and tensile strength is greatly improved. Consequently, by using these copper materials, there have effects that fine lines whose characteristics are high electro-conductivity and high tensile strength, are manufactured economically.

What is claimed is:

1. A manufacturing method of an alumina dispersed reinforced copper alloy comprising the steps of:

preparing a powder consisting of particles of aluminum-contained copper alloy with an average diameter of approximately 20 $\mu$m by a water-atomization method;

milling thus obtained aluminum-contained copper alloy powder within an air atmosphere with use of a ball mill to perform a mechanical-alloying operation by shock compression, in which forging and granulation are repeated to cause the alloying to progress while inducing diffusion phenomenon between metallic finely divided particles under forging, while solidifying thereof, in order to change said powder into an oxidized powder;

converting aluminum into aluminum-oxide by heat-treating said oxidized powder with an inert atmosphere;

reducing thus obtained material with a reducing atmosphere; and hot extruding the reduced material.

2. A manufacturing method for an alumina-dispersed reinforced copper alloy according to claim 1, wherein a ratio of aluminum to copper is set to about 0.1 to about 0.6 weight-% when said alumina-dispersed reinforced copper is used for material for electric wires.

3. A manufacturing method for an alumina-dispersed reinforced copper alloy according to claim 1, wherein the material of balls used in said mill has characteristics of a high degree of hardness and minimal wear, such as a wear resistance alloy consisting of stainless steel or carbide-alloy, or ceramics such as alumina, or zirconia.

4. A manufacturing method for an alumina-dispersed reinforced copper alloy according to claim 1, wherein a crush-oxidation treating time is of a necessary time for combining contained aluminum with enough amount of oxygen wherein aluminum is converted into aluminum-oxide in a subsequent internal oxidation process.

5. A manufacturing method for an alumina-dispersed reinforced copper alloy according to claim 1, wherein diameter of an obtained particle is generally less than 150 $\mu$m in such a process.

6. A manufacturing method for an alumina-dispersed reinforced copper alloy according to claim 1, where said aluminum-contained copper alloy powder is obtained by said water-atomization method in such a manner that melted aluminum copper alloy containing approximately 0.35 weight % of aluminum is contacted with a water jet, and said oxidized powder is obtained by milling the aluminum-contained copper alloy powder with a zirconia-made centrifugal-rotary ball mill, wherein zirconia-made balls having approximately 10 mm-diameter are rotated at about 250 rpm with an air atmosphere.

7. A manufacturing method for an alumina-dispersed reinforced copper alloy according to claim 1 wherein said oxidized powder is put into an alumina-made container and is treated at an approximately 700° C.-one-hour heat-treating within a nitrogen-atmosphere so that aluminum with the alloy is converted into aluminum-oxide while the majority of copper oxide is reduced to copper.

8. A manufacturing method for an alumina-dispersed reinforced copper alloy according to claim 7, wherein the materials are crushed after cooling so as to provide a particle size in approximately 60$\mu$, said crushed materials are put into an alumina-made container and are treated at an approximately 500° C.-one-hour heat-treating within a hydrogen-atmosphere so that all remaining copper-oxides are reduced to copper.

* * * * *